United States Patent [19]

Kanamaru et al.

[11] Patent Number: 4,982,651

[45] Date of Patent: Jan. 8, 1991

[54] COMPRESSOR FOR COMPRESSING GASES

[75] Inventors: Hisanobu Kanamaru, Katsuta; Kenichi Gunji, Ibaraki, both of Japan

[73] Assignees: Hitachi, Ltd., Tokyo; Hitachi Automotive Engineering Co., Ltd., Katsuta, both of Japan

[21] Appl. No.: 203,930

[22] Filed: Jun. 8, 1988

[30] Foreign Application Priority Data

Jun. 10, 1987 [JP] Japan ..... 62-143162

[51] Int. Cl.[5] ..... F04B 1/20

[52] U.S. Cl. ..... 91/499

[58] Field of Search ..... 91/499, 504 H, 507

[56] References Cited

U.S. PATENT DOCUMENTS

| | | | |
|---|---|---|---|
| 1,785,355 | 12/1930 | Lawser | 91/488 |
| 2,261,471 | 11/1941 | Hull | 417/269 |
| 2,405,006 | 7/1946 | Ashton | 417/222 |
| 3,010,403 | 11/1961 | Zubaty | 92/12.2 |
| 3,062,434 | 11/1962 | Elwell | 417/271 |
| 3,129,702 | 4/1964 | Arbanas | 417/269 |
| 3,228,346 | 1/1966 | Johnson | 91/488 |
| 3,611,879 | 10/1971 | Alderson | 91/507 |
| 3,691,910 | 9/1972 | Reichel | 91/507 |
| 4,480,964 | 11/1984 | Skinner . | |
| 4,771,676 | 9/1988 | Matsumoto | 91/499 |

FOREIGN PATENT DOCUMENTS

| | | | |
|---|---|---|---|
| 248881 | 4/1926 | Italy | 91/499 |
| 226578 | 10/1986 | Japan | 91/499 |
| 1198246 | 12/1985 | U.S.S.R. | 91/499 |
| 313972 | 5/1930 | United Kingdom | 91/507 |

*Primary Examiner*—Leonard E. Smith

*Attorney, Agent, or Firm*—Antonelli, Terry, Stout & Kraus

[57] ABSTRACT

A compressor comprises a plurality of pistons each received in one of through holes formed in a cylinder block fixedly mounted on a rotational shaft which is journaled by a stationary part, and a wobble plate arranged in such a manner as oppose and be inclined with respect to an end surface of the cylinder block. The wobble plate is supported on the rotational shaft for wobbling movement and rotatably holds one ends of the pistons. There are provided a pair of driving pins having one end portions secured to the cylinder block and extending in parallel with the rotational shaft, and the other ends slidably engaging the wobble plate through spherical bearings. The wobble plate, the driving pins and the spherical bearings constitute in cooperation a piston driving mechanism portion.

10 Claims, 3 Drawing Sheets

COMPRESSOR FOR COMPRESSING GASES

BACKGROUND OF THE INVENTION

This invention relates to a compressor, and more particularly to a compressor having a mechanism which makes it suitable to use as an air compressor for vehicles in which the discharging pressure thereof is obtained by delivering under pressure a gaseous working fluid.

Conventional compressors are constituted in such a manner that, for example as disclosed in FIG. 1 of Japanese Patent Laid-Open No. 61-237887, a cylinder block, a wobble plate and pistons rotatably supported by the wobble plate are rotated, through a pair of bevel gears, around the axes of the shafts inclined relative to each other, and the rotation of these elements is caused in synchronization with each other. As a result of the substantial swinging or wobbling movement of the wobble plate, the pistons are reciprocated within the through holes or the cylinder bores so that a suction, compression, and discharge processes may be conducted. The bevel gears serve as a mechanism for transmitting a torque between the inclined shafts.

However the bevel gears employed in the prior art as the mechanism for transmitting torque between the inclined shafts are desired to be eliminated, since they may generate a noise due to its backlash, impair reliability of the product and give uncomfortable feeling to users. Furthermore, the prior art is constructed such that each of the driving shaft and the driven shaft is supported in a cantilever fashion through a single bearing, and that centering between the two shafts is effected through a ball disposed at the central portion of the bevel gears engaging with each other. With such construction, since not only the thrust force (force in the axial direction) but also the radial force are applied to the shafts, the shafts are caused to be oscillated, and hence uneven wear of the spherical bearing portion including the ball as well as the uneven wear and vibration of the bevel gears would occur. As a result, noise generation cannot be prevented.

Furthermore, in the case where the capacity of the compressor is intended to be controlled, since the inclination angle of the rotation center axis of the wobble plate cannot be varied, the refrigerant having been sucked in the cylinder bore has to be returned to the passage of low pressure side during the compression process so as to control the amount of the discharged gas. Therefore, problems arise in that the temperatures of the sucked gas and the discharged gas are raised, and hence the volumetric efficiency and the mechanical efficiency are deteriorated.

A compressor of cylinder rotating type similar to that disclosed in Japanese Patent Laid-Open No. 61-237887 is disclosed in U.S. Pat. No. 4,644,850. Also U.S. Pat. Nos. 3,656,299, and 4,283,997 disclose similar arts. However, the structure disclosed in these U.S. Patents are substantially identical with the above-described prior art structure in the mechanism for rotating the wobble plate.

SUMMARY OF THE INVENTION

It is an object of the present invention to provide a compressor which may reduce mechanical loss and hence is operable at high efficiency and with reduced noise generation.

This object is achieved by adopting the structure in which a torque transmission between a cylinder block and a wobble plate concentrically arranged on a rotational shaft is effected through a pair of driving pins secured into the cylinder block through an end surface of the latter and located on a diagonal line, and spherical bearings held or supported in driving holes formed in the wobble plate in a manner to permit relative movement between the driving pins and the driving holes.

The torque transmission between the cylinder block and the wobble plate is effected through a pair of the driving pins secured into the cylinder block and the spherical bearings movable on the driving pins and supported in the driving holes in a manner to permit relative movement in a radial direction between the driving pins and the driving holes, and the torque transmitted from the rotational shaft to the cylinder block is transmitted to the wobble plate in a synchronized manner. The rotation of the wobble plate along an inclined surface does not impair the synchronized rotation of the cylinder block and the wobble plate, since the spherical bearings are movable on the driving pins and the driving pins are held in the driving holes in a manner to permit relative movement therebetween in a radial direction.

DETAILED DESCRIPTION OF THE PREFERRED EMBODIMENTS

An embodiment of the present invention will now be described with reference to the accompanying drawings.

Figure 1:
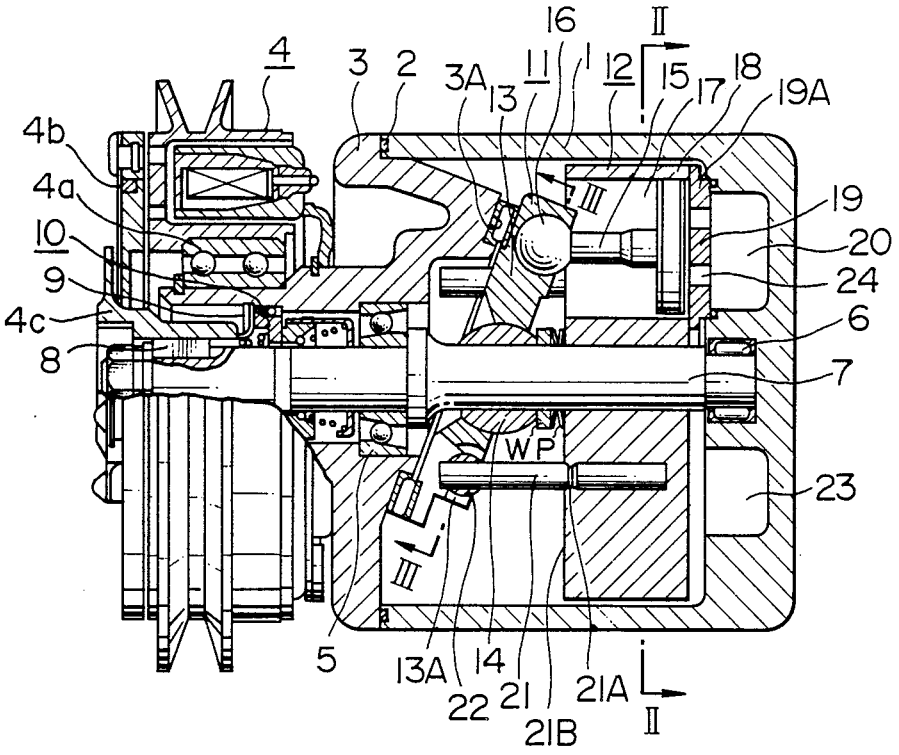
FIG. 1 is a side elevational cross-sectional view of an essential portion of a compressor according to an embodiment of the present invention.
Figure 2:
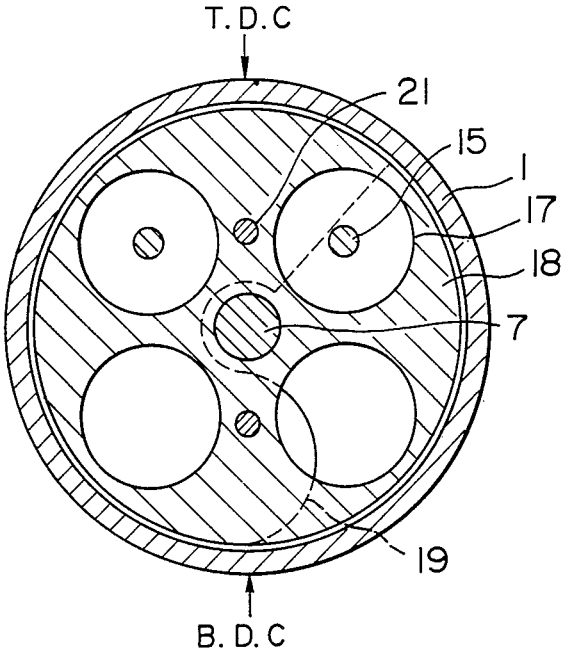
FIG. 2 is a cross-sectional view taken along the line II—II of FIG. 1.
Figure 3:
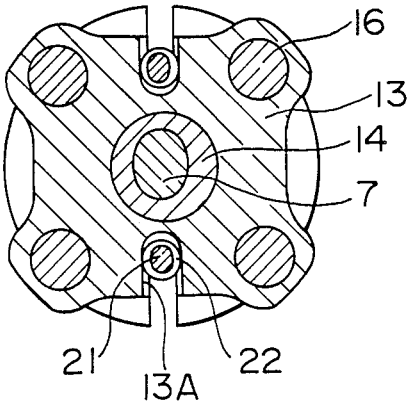
FIG. 3 is a cross-sectional view taken along the line III—III of FIG. 1.

FIG. 1 is a side elevational cross-sectional view of an essential portion, FIG. 2 is a cross-sectional view taken along the line II—II of FIG. 1 and FIG. 3 is a cross-sectional view taken along the line III—III of FIG. 1. Referring to these drawings, a side cover 3 made of aluminum and provided with an inclined surface 3A is disposed and secured through an "O" ring 2 to the open side of a cup-shaped casing 1 made of aluminum. A rotor of a magnet clutch 4 is fitted through a bearing 4*a* onto an outer periphery of a projection provided at the central portion of the side cover 3. An armature 4*b* of the magnet clutch 4 is connected to a boss 4*c* held, through the raidal bearings 5 and 6, at the center of the side cover 3 and the casing 1. The boss 4*c* is connected to a rotational shaft 7 by means of a keyway 8. A mechanical seal mechanism 10 is provided between the side cover 3 and the rotational shaft 7, the mechanical seal mechanism 10 being prevented from being separated or disassembled by means of a clip 9.

A motion conversion mechanism portion 11 and an operating fluid chamber assembly 12 are accommodated in the casing 1. The motion conversion mechanism portion 11 is constituted in such a manner that a wobble plate 13 thereof is rotatably supported by a center ball 14 whose central portion is fitted onto the rotational shaft 7, and spherical portions 16 of pistons 15 are rotatably supported in the internal end of the wobble plate 13 near the periphery of the latter, the spherical portions 16 being arranged at locations on the same circle.

On the other hand, the operating fluid chamber assembly 12 comprises: a cylinder block 18 made of aluminium material and having even numbered through holes 17 extending in the axial direction, the cylinder block having a central hollow portion secured onto the rotational shaft 7; pistons 15 fitted in the corresponding through holes 17; and a cylinder head 19 having a projection 19A fitted in a high-pressure chamber 20, and covering the open end of the cylinder block 18.

Driving pins 21 made of steel are press-fitted into the cylinder block 18 through an axially inner end surface 21B of the latter. The portions of the end surface of the cylinder block 18 adjacent to the peripheries of the driving pins 21 are locally plastically deformed and the plastically deformed material is plastically flowed into connection grooves 21A which have been previously formed in the driving pins 21, so that an excellent accuracy in connection is achieved.

The driving pins 21 are, as can be clearly seen from FIG. 2, disposed between the even numbered through holes 17 formed in the cylinder block 18, and are disposed in a pair on a straight line passing through the center axis of the rotational shaft 7. The driving pins 21 are disposed slightly more radially inward than the centers of the through holes 17, as measured radially outwardly from the position of the shaft 7, for the purpose of limiting the length of the driving pins 21 to the shorter one.

Onto the free ends cf the driving pins 21 are slidably fitted spherical bearings 22. The spherical bearings 22 are, as shown in FIG. 3, inserted from the outside radially inwardly into arc-shaped driving holes 13A which extend radially. The spherical bearings 22 are rotatable in the driving holes 13A, and the holes 13A are movable in radial directions relative to the bearings 22. A wave-spring P and a washer W are mounted at a location between the center ball 14 and the cylinder block 18 in a manner to surround the rotational shaft 7, and the wave-spring P always presses the center ball 14 through the washer W. However, since the outer surface of the center ball 14 is held by the wobble plate 13, the ball 14 is prevented from being excessively displaced and hence from being separated or disassembled.

In the compressor having the structure described above, when the rotational shaft 7 is rotated by, for example, an internal combustion engine, the driving pins 21 and the spherical bearings 22 are also rotated so that the spherical bearings 22 transmit a rotational torque to the driving holes 13A. At this time, since the wobble plate 13 rotates about a center axis of the center ball 14 along the inclined surface 3A of the side cover 3, the relative position between the wobble plate 13 (or the holes 13A) and the spherical bearings 22 is varied as viewed in a radial direction. However, since the holes 13A are radially movable relative to the spherical bearings 22, the variation of the above mentioned relative position is absorbed and the synchronized rotation between the cylinder block 18 and the wobble plate 13 is not hindered so that the rotation can be conducted smoothly. Since the cylinder block 18 and the wobble plate 13 are rotated in a synchronized manner as described above, the pistons 15 effect apparent reciprocating movement within the though holes 17. For example, when the cylinder block 18 is rotated in a clockwise direction as viewed in FIG. 2, the piston 15 located near the influx starting end of the low pressure chamber 23 is located at a position slightly away from the top dead center (TDC) toward the bottom dead center (BDC). As the cylinder block 18 rotates clockwise, the piston 15 moves toward the bottom dead center (BDC), and it is located at a position slightly closer to the top dead center (TDC) from the bottom dead center (BDC) when the piston is located at the position near the influx completing end of the low pressure chamber 23. As the cylinder block 18 further rotates, the piston 15 tightly seals the though hole 17 in cooperation with the cylinder head 19 and approaches the top dead center (TDC) while discharging the compressed fluid through a discharge port 24.

As described above, according to the above-described embodiment of the invention, since torque transmission can be conducted through a joint, a sufficiently quiet air compressor of cylinder rotating type can be obtained in which noise due to backlash of the gears, and vibrations and noise due to oscillatory movement of a rotational shaft can be prevented from being generated.

A pair of the driving pins of the cylinder block provide an excellent torque transmission efficiency, and can assuredly transmit the driving force.

Furthermore, since the center ball rotates basically in synchronization with the rotational shaft and the wobble plate, the compressor is operable with reduced frictional resistance and reduced noise generation.

Figure 4:
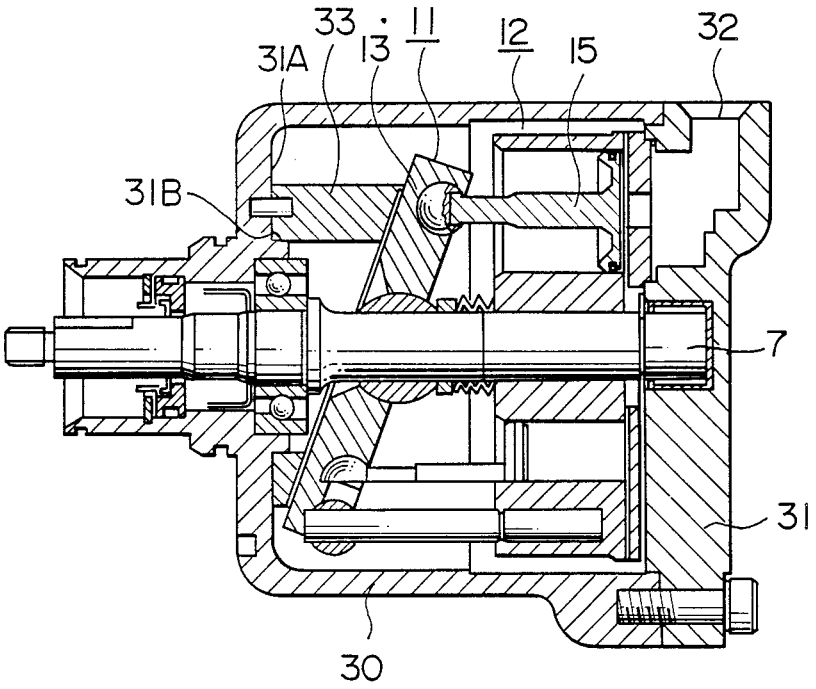
FIG. 4 is a side elevational cross-sectional view of an essential portion of a compressor according to another embodiment.

FIG. 4 is a cross-sectional view of a compressor according to another embodiment. A cup-shaped casing 30 covers or encloses the motion conversion mechanism portion 11 including the wobble plate 13, and the operating fluid chamber assembly 12. A discharge port 32 is formed in a side cover 31 airtightly connected to the casing 30. The most important feature of this embodiment resides in that a stepped surface 31B is provided on the inner surface 31A of the casing 30, and a spacer 33 is disposed on the stepped surface 31B, the spacer 33 engaging and supporting the rear surface of the wobble plate 13.

This spacer 33 is in the form of a ring having a tapered surface and its size and structure are designed to receive the thrust force imparted from the pistons 15. The surface of the spacer 33 which makes sliding engagement with the wobble plate 13 is applied with a fluororesin film or layer of the thickness of several millimeters. As a result, sliding, frictional resistance can be kept low, and noise can be kept lower and the length of the shaft can be made shorter than the case where the thrust bearing is provided.

According to the invention, since torque transmission can be conducted through a joint, a compressor can be provided in which mechanical loss is suppressed, and high operational efficiency is achieved with reduced noise generation.

We claim:

1. In a gas compressor comprising a rotational shaft journaled by a stationary part, a cylinder block arranged in a fixed relationship with said rotational shaft for rotation with the shaft and formed with a plurality of through holes defining therein working fluid chambers, and piston driving means including a wobble plate arranged in an inclined manner to oppose one end surface of said cylinder block and rotatably holding one ends of said pistons, the compressor being constructed such that, when said cylinder block is rotated together with said rotational shaft, a fluid is sucked from a low pressure passage into said working fluid chambers and is discharged therefrom into a high pressure passage, the improvement wherein:

said wobble plate is supported on said rotational shaft for rotation with said shaft and for wobbling movement, and said piston driving means further includes only two driving pins having one end portions secured to said cylinder block for fixedly holding the pins so they extend parallel with said rotational shaft, said driving pins having the other end portions slidably engaging said wobble plate through spherical bearings.

2. A compressor according to claim 1, wherein said wobble plate is supported on said rotational shaft for wobbling movement through a center ball fitted onto said rotational shaft.

3. A compressor according to claim 1, wherein said spherical bearings are located near an outer periphery of said wobble plate and are rotatably received in driving holes formed in said wobble plate and opened to the outer periphery of the latter, said spherical bearings and said driving holes being relatively movable in a radial direction.

4. A compressor according to claim 1, wherein said driving pins have center axes located radially inwardly from center axes of said pistons.

5. A compressor according to claim 1, wherein said cylinder block has even number of through holes formed at locations radially equidistantly spaced apart from said rotational shaft, and said pair of driving pins are arranged at positions between said through holes and on a straight line passing a center axis of said rotational shaft.

6. A compressor according to claim 2, where said driving pins are press-fitted into said cylinder block and are secured thereto with the material of said cylinder block partially plastically deformed toward peripheries of said driving pins.

7. In a compressor gas comprising a rotational shaft journaled by a stationary part, a cylinder block arranged in a fixed relationship with said rotational shaft for rotation with the shaft and formed with a plurality of through holes, pistons respectively received in said through holes and defining therein working fluid chambers, and piston driving means including a wobble plate arranged to oppose said cylinder block and rotatably holding one ends of said pistons, the compressor being constructed such that, when said cylinder block is rotated together with said rotational shaft, a fluid is sucked from a low pressure passage into said working fluid chambers and is discharged therefrom into a high pressure passage, the improvement wherein:

said wobble plate is supported on said rotational shaft for rotation with said shaft and for wobbling movement through a center ball; and said piston driving means further includes only two driving pins having one end portions embedded into said cylinder block through one end surface of the latter and secured thereto by the pressure of partial plastical deformation of the material of said cylinder block toward peripheries of said driving pins, said driving pins extending in parallel with said rotational shaft, and spherical bearings slidably fitted on the other end portions of said driving pins and held in said wobble plate near the periphery of the latter in a manner to permit relative movement in a radial direction between said spherical bearings and said wobble plate.

8. A compressor according to claim 7, wherein said wobble plate faces and engages an inner inclined surface of a side cover through a thrust bearing.

9. A compressor according to claim 7, wherein said wobble plate faces and engages an inclined surface of a spacer mounted on a casing.

10. A compressor according to claim 9, wherein said spacer and said wobble plate engage with each other through a fluororesin film.

* * * * *